US006068542A

United States Patent [19]

Hosokai

[11] Patent Number: 6,068,542

[45] Date of Patent: May 30, 2000

[54] PAD TAPE SURFACE POLISHING METHOD AND APPARATUS

[75] Inventor: Nobukazu Hosokai, Nagaoka, Japan

[73] Assignees: TOMOE Engineering Co, Ltd., Tokyo; Sanshin Co., Ltd., Niigata-ken, both of Japan

[21] Appl. No.: 08/882,468

[22] Filed: Jun. 25, 1997

[30] Foreign Application Priority Data

Jul. 24, 1996 [JP] Japan ..... 8-194830

[51] Int. Cl.[7] ..... B24B 1/00; B24B 21/00

[52] U.S. Cl. ..... 451/37; 451/59; 451/168; 451/306; 451/307; 451/310; 451/393; 451/396

[58] Field of Search ..... 451/36, 37, 41, 451/59, 63, 171, 306, 307, 308, 310, 393, 396, 398

[56] References Cited

U.S. PATENT DOCUMENTS

| | | | |
|---|---|---|---|
| 3,668,814 | 6/1972 | Freerks et al. | 451/306 X |
| 3,906,678 | 9/1975 | Roth | 451/317 |
| 5,276,999 | 1/1994 | Bando | 451/306 X |
| 5,575,707 | 11/1996 | Talieh et al. | 451/173 |
| 5,593,344 | 1/1997 | Weldon et al. | 451/307 X |
| 5,722,877 | 3/1998 | Meyer et al. | 451/307 X |

*Primary Examiner*—Timothy V. Eley
*Attorney, Agent, or Firm*—Sprung Kramer Schaefer & Briscoe

[57] ABSTRACT

A surface polishing method comprises allowing a holder to hold a flat sheet-like workpiece, placing a pad tape in a location opposite to the holder, the pad tape consisting of a tape substrate and grains bonded to the substrate surface, supplying free grains between the holder and the pad tape, and rotating the holder and/or a mechanism holding the tape, thereby causing the free grains to polish the workpiece. An apparatus for practicing the method comprises a holder capable of holding a flat sheet-like workpiece, a tape holding mechanism located opposite to the surface of the workpiece and carrying a pad tape which consists of a tape substrate and grains bonded to the substrate, a rotary mechanism for rotating the holder and/or the tape holding mechanism, and an abrasive supplying mechanism for supplying free grains between the surface of the workpiece and the pad tape. The apparatus may further comprise a tape conveying mechanism for feeding the pad tape intermittently and/or a rocking mechanism for rocking the holder or the tape holding mechanism. The rotary mechanism maybe designed to cause eccentric motion or planetary motion of the holder.

10 Claims, 9 Drawing Sheets

PAD TAPE SURFACE POLISHING METHOD AND APPARATUS

BACKGROUND OF THE INVENTION

This invention relates to a method and apparatus for surface polishing of flat workpieces in the form of films or sheets; such as the surface of interlayer films deposited in the course of device fabrication, e.g., of memories and logic devices; glass substrates of liquid crystal filters; and substrates of plasma display units.

A flat sheet-like workpiece W of the character, for example, a wafer on which devices are to be fabricated, takes the form of a disk as illustrated in FIG. 12. Typically, on a silicon wafer a, as shown in FIG. 13, a first layer of conductive pattern b of aluminum or other conductive metal is formed; an interlayer film c of a highly dielectric metal of $SiO_2$ system or the like is deposited on the conductive pattern b as in FIG. 14; the surface of the interlayer film c is smoothed by polishing and formed with contact holes d as in FIG. 15; a second patterned conductive layer e is formed as in FIG. 16; and the foregoing series of steps is repeated to form an interlayer film on the second patterned conductive layer e and polish and smooth the surface of the interlayer dielectric film c; and ensuing layers are deposited one over another to form a 4-, 5-, 6-, or even more multiple layer laminate of a highly complex patterned conductive structure.

As apparatus for polishing the surface of such flat sheetlike workpieces, lapping machines are in common use. To prevent slight polishing strains and scratches, they use a pad of preselected hardness or a lapping table or pad having surface irregularities in a predetermined pattern. Abrasive in the form of free grains is supplied to the space between the lapping table or pad and the workpiece, and the latter surface is polished while the opposing surfaces and grains in between are all in a rotating mode.

With the conventional arrangement, for example, for the polishing of a device wafer surface, it is thought necessary to remove dents and other surface projections preferentially and remove all other irregularities to produce a uniformly smooth surface, irrespective of the dimensions of the device pattern or of the density of the substrate texture. These requirements combine with slender machining allowances to make the operating conditions of the lapping machine most exacting. Moreover, the recent tendency toward larger device wafers has called for more massive lapping machines with greater complexities in handling the wafers, sometimes at a sacrifice of the operating efficiency. Further, where the construction is such that the lapping table or pad has patterned surface irregularities, the lapping machine is very expensive to manufacture and yet is not assured of durability. Such machines score low on both economy and high speed machinability.

SUMMARY OF THE INVENTION

The present invention aims at solving these problems of the prior art. The invention resides in a surface polishing method which is characterized by allowing a holder to hold a flat sheet-like workpiece, placing a pad tape in a location opposite to the holder, said pad tape consisting of a tape substrate and grains bonded to the substrate surface, supplying free grains between the holder and the pad tape, and rotating the holder and/or a mechanism holding the tape, thereby causing the free grains to polish the workpiece.

The invention further resides in a surface polishing apparatus which is characterized by a holder capable of holding a flat sheet-like workpiece, a tape holding mechanism located opposite to the surface of the workpiece and carrying a pad tape which consists of a tape substrate and grains bonded to the substrate, a rotary mechanism for rotating the holder and/or the tape holding mechanism, and an abrasive supplying mechanism for supplying free grains between the surface of the workpiece and the pad tape.

The invention is characterized by further comprising a tape conveying mechanism for feeding the pad tape intermittently. The invention is characterized by further comprising a rocking mechanism for rocking the holder or the tape holding mechanism. The invention is further characterized in that the rotary mechanism is designed to cause eccentric motion or planetary motion of the holder.

DESCRIPTION OF THE PREFERRED EMBODIMENTS

Figure 1:
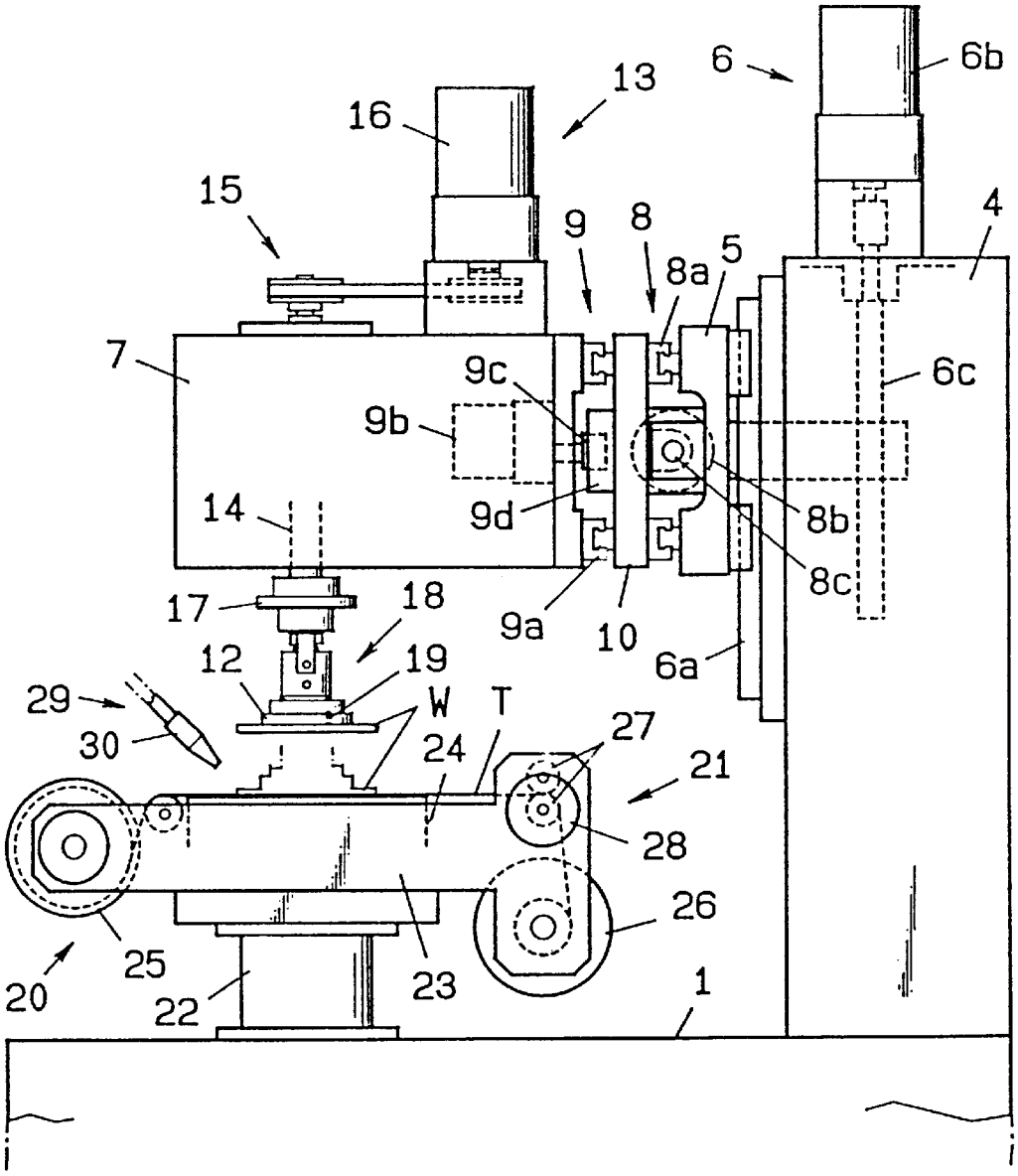
FIG. 1 is a general side view, partly in section, of a first embodiment of the invention.
Figure 2:
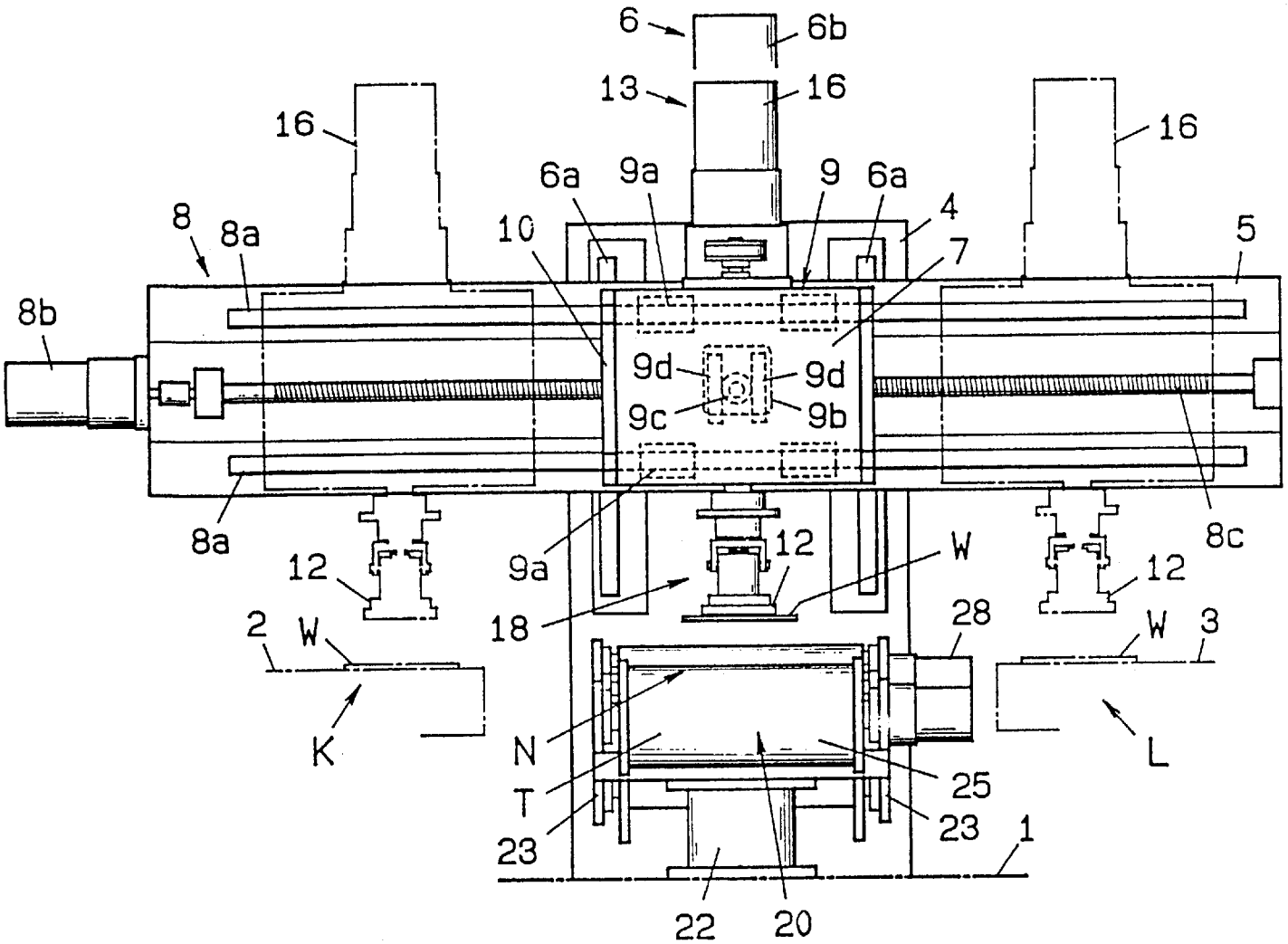
FIG. 2 is a general front view, partly in section, of the first embodiment.
Figure 3:
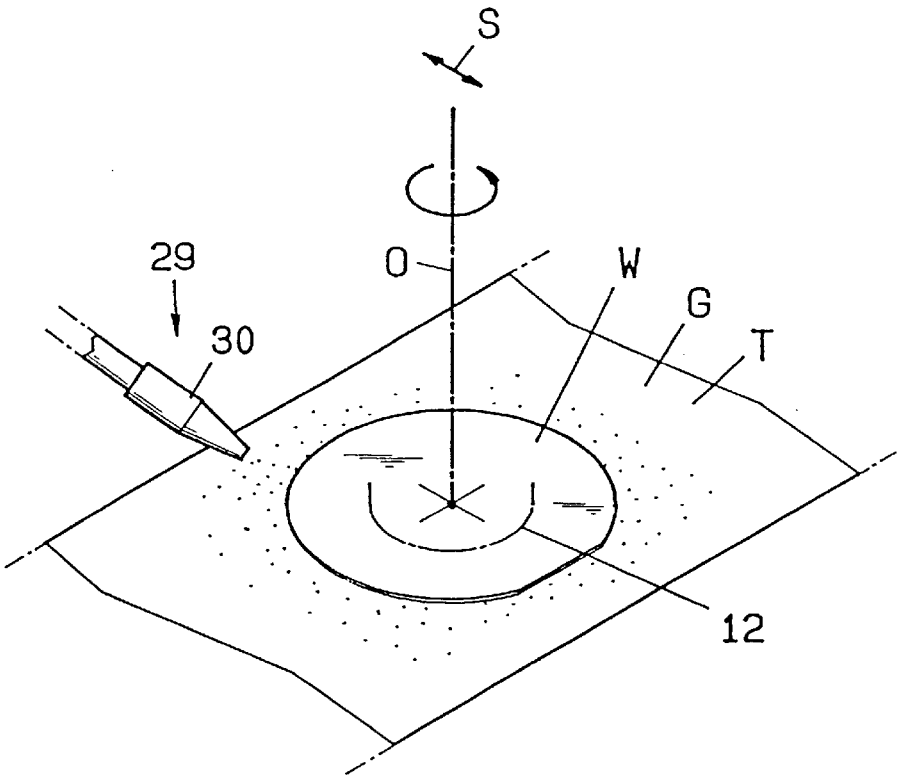
FIG. 3 is a perspective view explanatory of the operation of the first embodiment.
Figure 4:
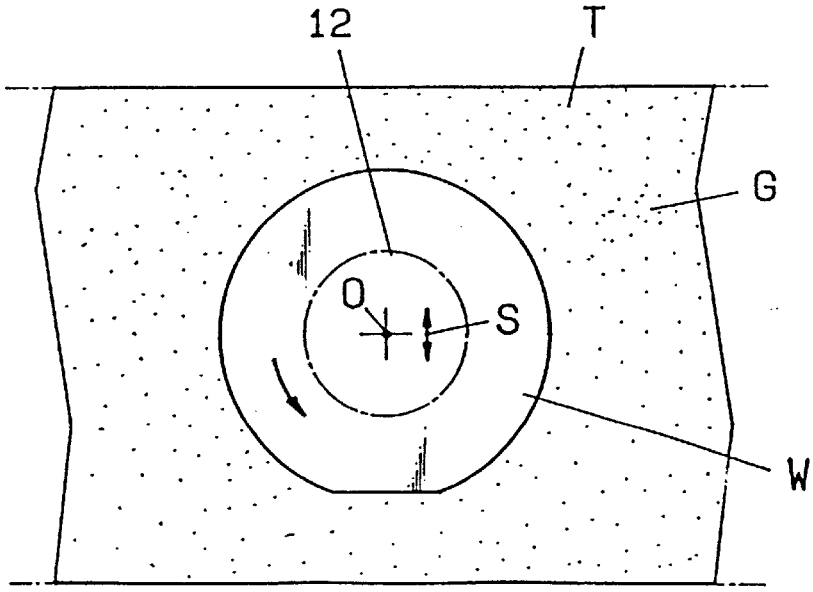
FIG. 4 is a plan view explanatory of the operation of the first embodiment.
Figure 5:
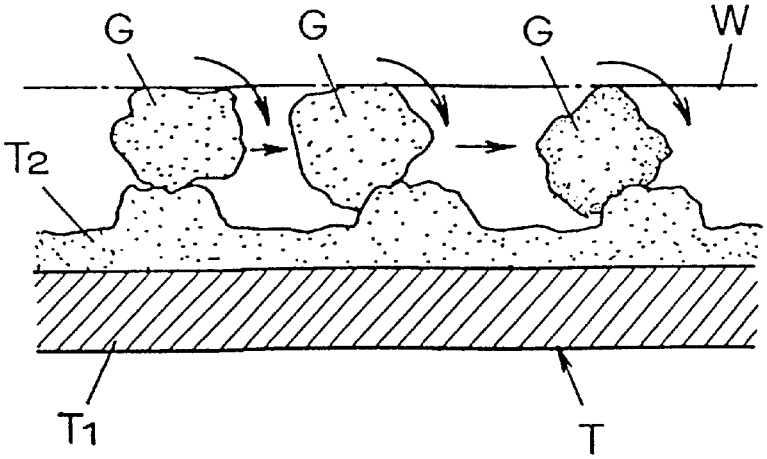
FIG. 5 is an enlarged fragmentary sectional view of a pad tape in the first embodiment of the invention.
Figure 6:
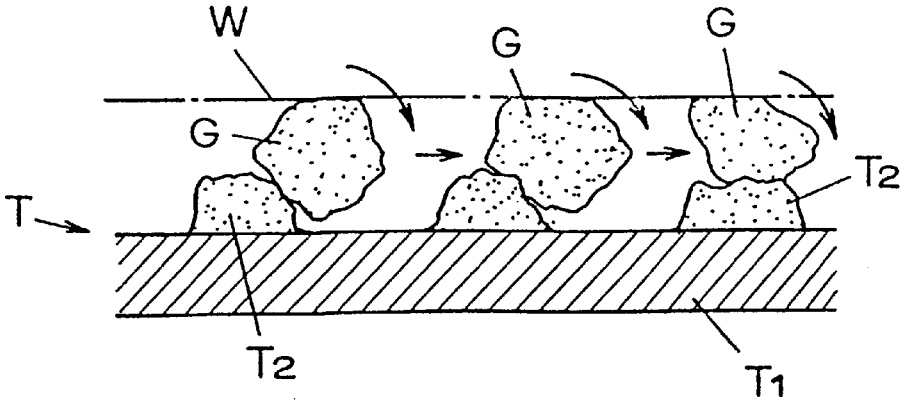
FIG. 6 is an enlarged fragmentary sectional view of another pad tape in the first embodiment.
Figure 7:
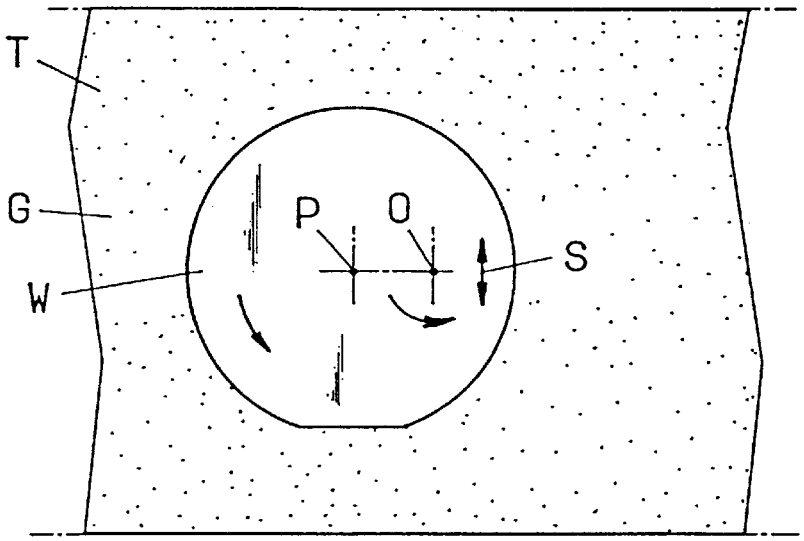
FIG. 7 is a plan view explanatory of the operation of a second embodiment of the invention.
Figure 8:
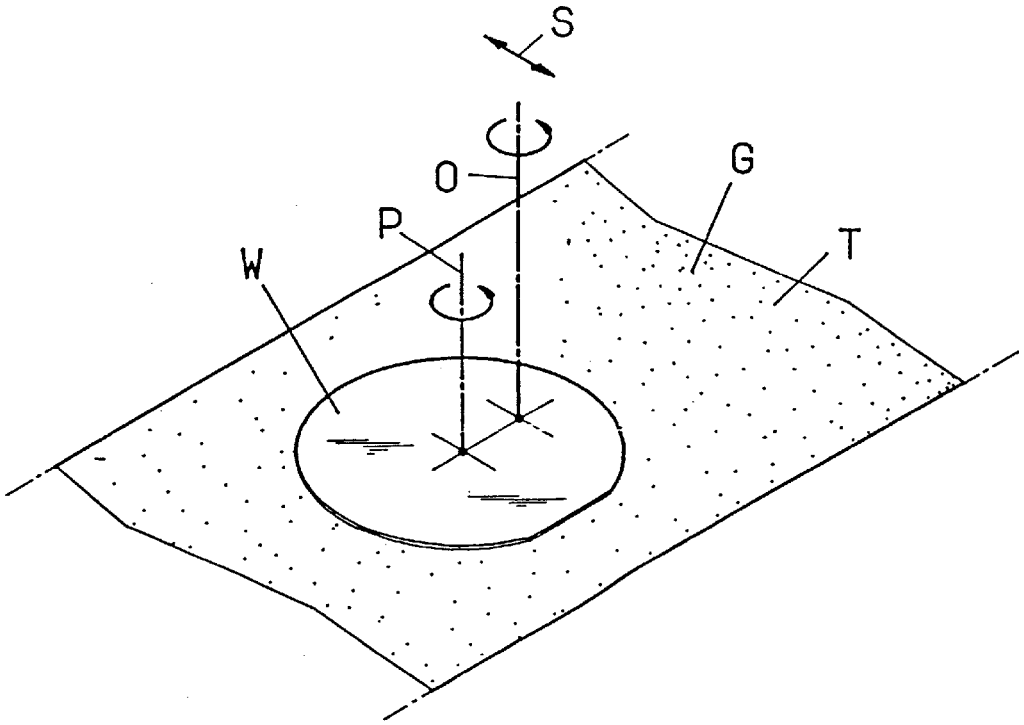
FIG. 8 is a perspective view explanatory of the operation of the second embodiment.
Figure 9:
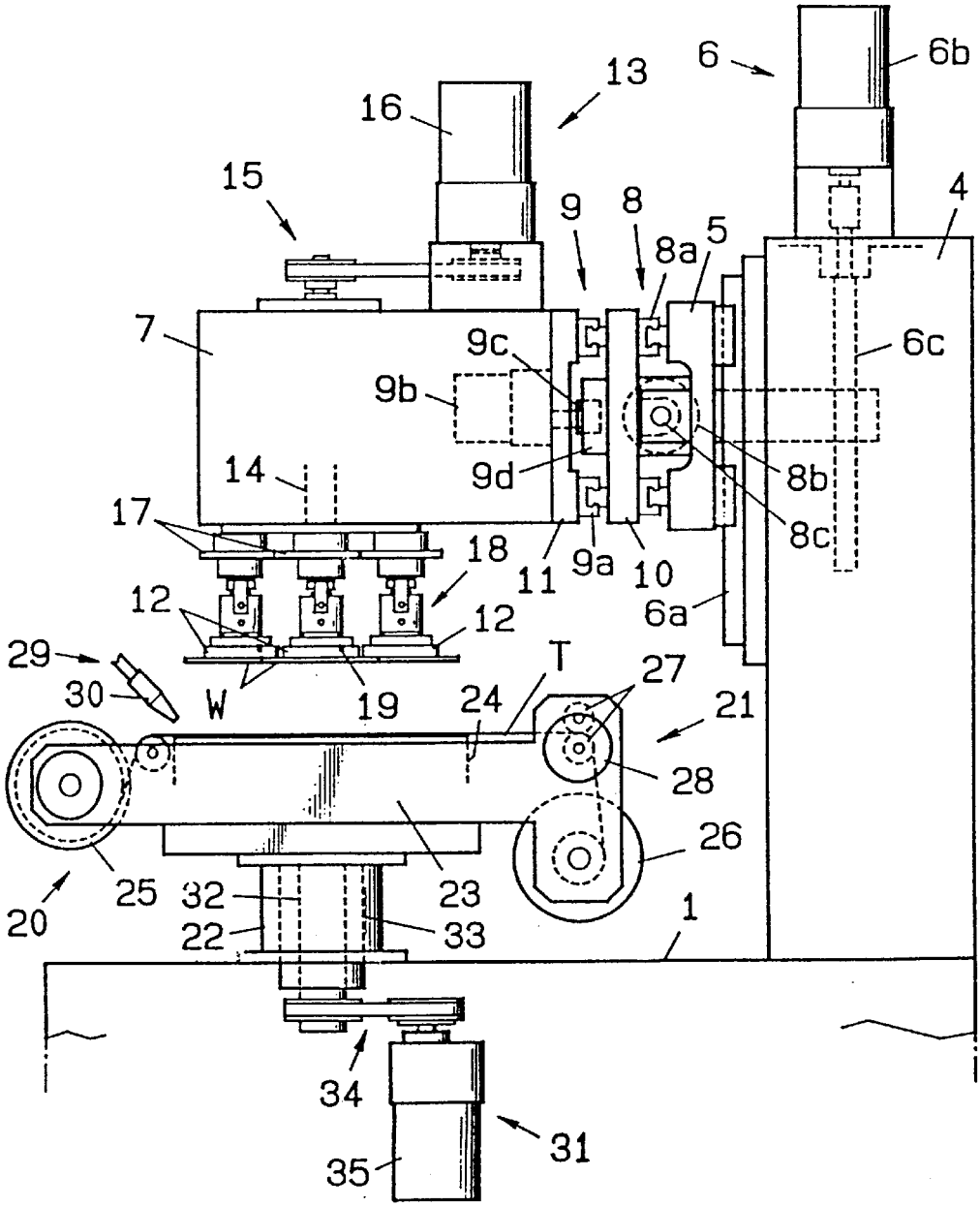
FIG. 9 is a general side view, partly in section, of a third embodiment of the invention.
Figure 10:
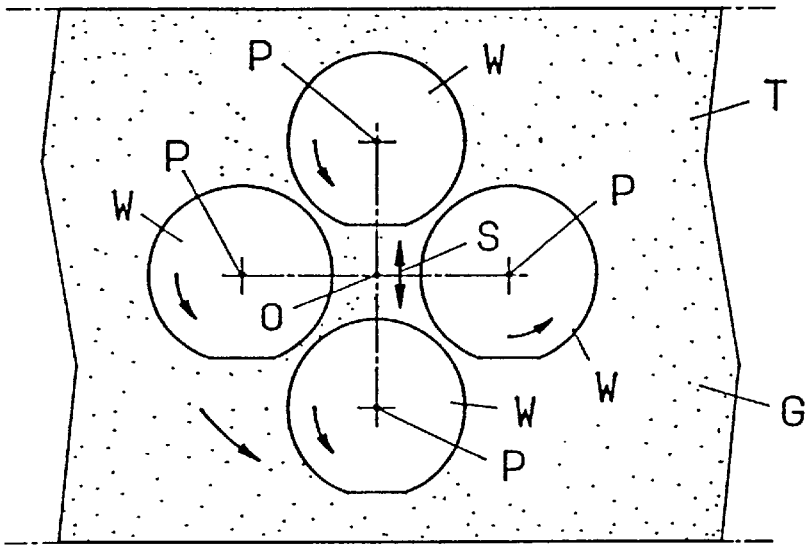
FIG. 10 is a plan view explanatory of the operation of the third embodiment.
Figure 11:
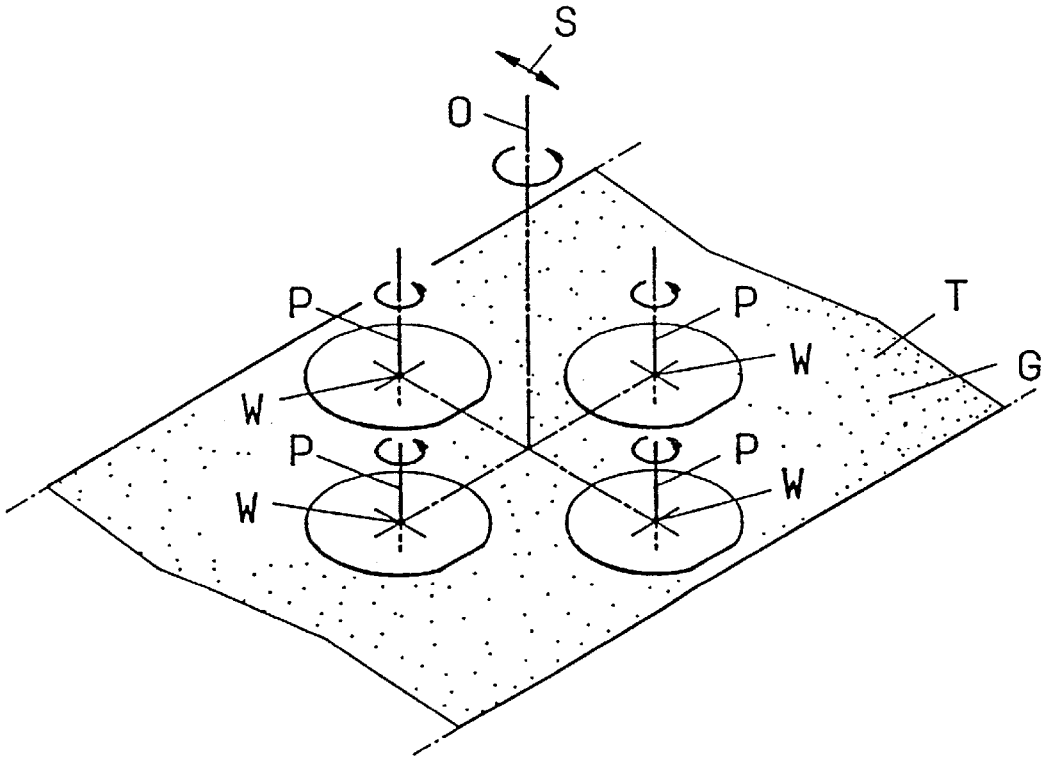
FIG. 11 is a perspective view explanatory of the operation of the third embodiment.
Figure 12:
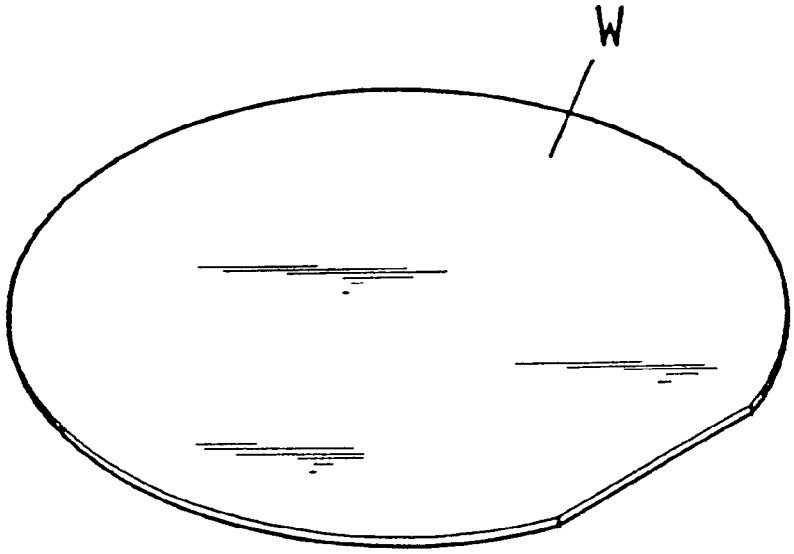
FIG. 12 is a perspective view of a device wafer.
Figure 13:
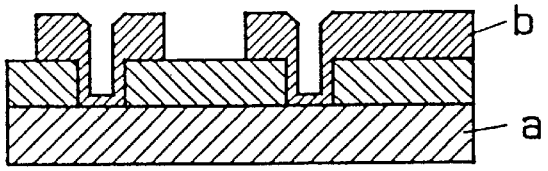
FIG. 13 is a sectional view of the device wafer in a stage of device fabrication.
Figure 14:
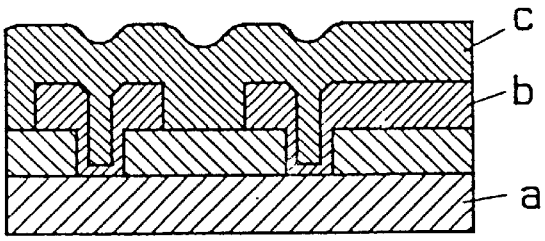
FIG. 14 is a sectional view of the device wafer in another stage of device fabrication.
Figure 15:
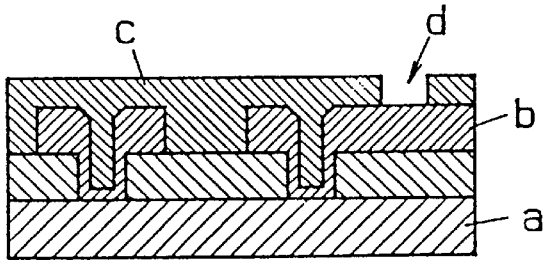
FIG. 15 is a sectional view of the device wafer in still another stage of device fabrication.
Figure 16:
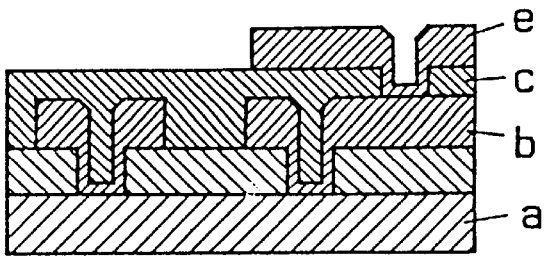
FIG. 16 is a sectional view of the device wafer in a further stage of device fabrication.

FIGS. 1 through 11 show three embodiments of the present invention, FIGS. 1 to 6 showing the first embodiment, FIGS. 7 and 8, the second embodiment, and FIGS. 9 to 11, the third embodiment.

In FIGS. 1 to 6 that illustrate the first embodiment of the invention, numeral 1 designates a base arranged, in spaced relationship, between a feed index table 2 and a discharge index table 3. On the rear part of the base 1 stands a column 4, which holds a support frame 5 so as to move it upward and downward by a vertical driving mechanism 6.

The vertical driving mechanism 6 comprises guide shaft bearings **6*a* securely fixed to the column 4 to carry the support frame 5 movably in vertical directions, a motor 6*b*** for vertical driving mounted on top of the column 4, and a screw linkage 6*c* for transmitting the power from the motor 6*b* to the support frame 5 for its upward or downward motion.

A machining head 7 is carried by the support frame 5 via a feed-delivery mechanism 8 so that it can move sidewise between a position K for feeding a flat sheet-like workpiece W on the feed index table 2 and a position L for taking out the workpiece W on the discharge index table 3, through a machining position N. The head can be rocked to the left and right by a rocking mechanism 9.

The feed-delivery mechanism 8 is constructed so that a carriage 10 is connected to the support frame 5 with guide shaft bearings 8*a* to be movable to the left and right, and a motor 8*b* for moving the carriage 10 is mounted on one end to move the carriage 10 to the left and right by means of a screw linkage 8*c*. The rocking mechanism 9 comprises guide shaft bearings 9*a* which rockably connect a rocker plate 11 to the carriage 10, a rocking motor 9*b* mounted to one side of the rocker plate 11, an eccentric cam 9*c* secured to the shaft of the rocking motor 9*b*, and a pair of parallel guide bars 9*d* attached to the carriage 10 in contact with the eccentric cam 9*c* in between, with the machining head 7 securely fixed to the rocker plate 11.

Numeral 12 indicates a holder and 13, a rotary mechanism. A spindle 14 is rotatably held in a bearing sleeve 15 vertically through the machining head 7. A motor 16 is mounted on the machining head 7 to drive the spindle 14 through a belt transmission 15. To the lower end of the spindle 14 is secured a carrier disk 17 for the holder 12, which in turn incorporates a work holding mechanism 18 of vacuum lifting type.

The vacuum lifting mechanism as a work holding mechanism 18 comprises the holder 12 having a plurality of sucking holes 19 open on the under surface and which extend through the holder body and communicated with a vacuum source not shown through a change-over valve not shown, so that a workpiece W can be lifted or released by means of a vacuum.

Numeral 20 designates a tape holding mechanism and 21, a tape conveying mechanism. A support drum 22 is fixed to the base 1, a frame 23 is mounted on the drum 22, a table plate 24 is provided in the middle of the fame surface. On the front and rear ends of the frame 23 are rotatably mounted a feed reel 25 and a take-up reel 26, respectively, with a length of pad tape T wound around the two reels, initially full on the feed reel and empty on the take-up reel. The tape comprises a tape substrate $T_1$ of polyester film, thin metal sheet, cloth or the like and grains $T_2$ of a predetermined size of aluminum oxide, chromium oxide, silicon carbide, diamond or the like applied or bonded to the substrate with a binder either irregularly or regularly in a given pattern, as shown in FIG. 5 or 6. A pair of feed rolls 27 are provided on one end of the frame 23, together with a motor 28 for intermittently driving one of the feed rolls 27 to pull the pad tape T out of the full feed reel 25 onto the empty reel 26, past the table plate 24 and feed rolls 27. The driving feed roll 27 conveys the pad tape intermittently as desired, depending on the number of polishing runs, polishing time, and the condition of the grains $T_2$, to bring a fresh portion of the tape to the position for use as a polishing pad.

Indicated at 29 is an abrasive supplying mechanism, which uses as free grains G the particles commonly used as a lapping agent, such as aluminum oxide (A, WA, corundum), silicon carbide (C, GC), or diamond. The free grains G are supplied from a container not shown through a nozzle 30 onto the pad tape T, directly when dry or, in the case of wet polishing, together with light oil, spindle oil, rape seed oil, machine oil, or other mixed machining liquid, or polishing fluid for so-called CMP, e.g., a fluid containing a chemical solution to soften the surface of the workpiece W. The free grains G thus supplied are then recovered and issued again from the nozzle 30.

With the construction described above, the first embodiment of the invention operates, e.g., for the surface polishing of an interlayer film of a workpiece W as a wafer in the course of device fabrication, in the following way. In the feed position K, the machining head 7 is lowered by the vertical driving mechanism 6, while a workpiece W is rotatingly fed onto the feed index table 2. The machining head 7 descends farther to bring the holder 12 into contact with the workpiece W. The holder 12 then picks up the workpiece W by the action of the vacuum lifting mechanism as a work holding mechanism 18. The vertical driving mechanism 6 then lifts the machining head 7 and holder 12 together, when the feed-delivery mechanism 8 moves the machining head 7 rightward as viewed in FIG. 2, from the feed position K to the machining position N.

In the machining position N, free grains G are supplied from the nozzle 30 onto a pad tape T, either in a dry state or in a wet atmosphere wherein a machining or polishing liquid, e.g., a polishing solution containing a chemical liquid that softens the surface, is supplied. At the same time, the vertical driving mechanism 6 lowers the machining head 7, and the workpiece W gripped under a vacuum by the holder 12 is turned about the axis O of the spindle 14 is polished in rotational contact with the grains G on the pad tape T.

Following the conclusion of a polishing run for a given period of time, the machining head 7 is lifted by the vertical driving mechanism 6. At the upper limit of the head, the workpiece W held by the holder 12 is transferred from above the machining position N to above the take-out position L by the feed-delivery mechanism 8. Above the latter position the machining head 7 and holder 12 are lowered by the driving mechanism 6 to the lowermost level, where the work holding mechanism 18 is turned off and, freed from the vacuum action, the holder 12 releases the workpiece W in place on the discharge index table 3, which in turn transfers it to a next station.

During the polishing operation, the surface of the workpiece W is rotationally polished with free grains G supplied onto the pad tape T that comprises a tape substrate $T_1$, and grains $T_2$ bonded to the substrate surface. The tape substrate serves as a pressure-receiving pad, and the free grains G that tumble over and around the grains $T_2$ accomplish polishing. The arrangement permits the free grains G to tumble well between the surface of the workpiece W and the pad tape T and polish the work surface satisfactorily. The polishing is further improved by a judicious choice of a set of conditions, i.e., the material and hardness of the tape substrate $T_1$, and the material and grain size of the grains $T_2$.

The tape conveying mechanism 21, designed to feed the pad tape T intermittently, conveys the tape at proper intervals depending on the number of polishing runs and the duration of each run and on the condition of the grains $T_2$. Each interval brings a new portion of the tape substrate forward as a fresh pad section, together with unused grains $T_2$ on it, allowing polishing to be carried out favorably.

The rocking mechanism 9 that rocks the holder 12 causes the latter to rock in the directions S. The rocking motion enhances the polishing action to bring better results.

FIGS. 7 and 8 illustrate a modified construction of the rotary mechanism 13, belonging to the second embodiment of the invention. In this case the holder 12 is so located under the machining head 7 as to rotate about an axis P off the central axis O of the spindle 14, while holding a workpiece W in the same manner as in the preceding embodiment. Thus the holder 12 is driven both about the axis O and about the axis P off the axis O, with the consequence that the single workpiece W can freely rotate on its axis while, at the same time, revolving eccentrically.

FIGS. 9 to 11 shows another modified construction as the third embodiment. Here, as the rotary mechanism 13, a total of four holders 12 are arranged below the machining head 7, each adapted to rotate about one of four axes P equidistantly off the central axis O of the spindle 14. The holders 12, each carrying a workpiece W in like manner, are driven both to revolve around the common axis O and rotate about their own axes P off the central axis O. Consequently, all the four workpieces W are simultaneously driven for planetary motion.

This embodiment is equipped with an additional rotary mechanism 31. The mechanism comprises a rotating shaft 32 horizontally turnably inserted through a bearing 33 into the support drum 22 on the base 1, and a motor 35 mounted in the base 1 to drive the rotating shaft 32 via a belt transmission 34. A frame 23 similar to that of the first embodiment is secured onto the top of the rotating shaft 32, and a tape holding mechanism 20 is horizontally turned thereon by the rotary mechanism 31.

The second and third embodiments of the invention modify the mode of the rotation of the workpiece W in the rotational polishing by the first embodiment. They allow a workpiece or workpieces W to be better polished in eccentric motion or planetary motion involving both rotation about its axis and revolution about a central axis. The third embodiment that combines the workpiece motion with the motion of the tape holding mechanism 20 itself accomplishes even better polishing.

While preferred embodiments have been described using mechanisms for rotary motion, tape feed, rocking, horizontal turning, etc., it is to be understood that the invention is not limited thereto. For example, contrary to the illustrated arrangements, a rocking mechanism may be adopted which rocks the tape holding mechanism 18 instead, or a rotary mechanism may be used which turns the tape holding mechanism rather than the holder 12. Also, the apparatus design may incorporate proper changes in the materials of the tape substrate $T_1$ and grains $T_2$ of the pad tape T and in the material of the free grains G.

As described above, in the invention, the surface of the workpiece, during the polishing operation, is rotationally polished with free grains supplied onto the pad tape that comprises a tape substrate and grains bonded to the substrate surface. The tape substrate serves as a pressure-receiving pad, and the free grains that tumble over and around the grains accomplish polishing. The arrangement permits the free grains to tumble well between the surface of the workpiece and the pad tape and polish the work surface satisfactorily. The polishing is further improved by a proper choice of the material and hardness of the tape substrate and the material and grain size of the grains.

In the invention, there is provided a tape conveying mechanism for intermittently feeding the pad tape, and it conveys the tape at proper intervals depending on the number of polishing runs and the duration of each run and on the condition of the grains. Each interval brings a new portion of the tape substrate forward as a fresh pad section, together with unused grains on it, allowing polishing to be carried out favorably. In the invention, there is provided a rocking mechanism that rocks the holder or tape holding mechanism. The rocking motion enhances the polishing action to bring better results. In the invention, the rotary polishing is improved by eccentric motion or planetary motion of the holder and hence of the workpiece.

With these features the invention can fully achieve the intended purposes.

What we claimed is:

1. A surface polishing method which comprises allowing a holder to hold a flat workpiece, placing a pad tape in a location opposite to the holder, said pad tape comprising a tape substrate and grains bonded to one surface of the tape substrate, supplying free grains between said holder and said pad tape, and rotating said holder about a first vertical axis and rotating a mechanism holding said pad tape about a second vertical axis, thereby causing said free grains to polish said workpiece.

2. A surface polishing method which comprises allowing a holder to hold a flat workpiece, placing a pad tape in a location opposite to the holder, said pad tape comprising a tape substrate and grains bonded to one surface of the tape substrate, supplying free grains between said holder and said pad tape, and rotating said holder about a vertical axis and reciprocating said holder in a horizontal direction, thereby causing said free grains to polish said workpiece.

3. The method according to claim 2, which further comprises rotating a mechanism for holding said pad tape about a vertical axis.

4. The method according claim 2, which further comprises feeding said pad tape intermittently from a feed reel to a take-up reel.

5. A surface polishing apparatus comprising a holder capable of holding a flat workpiece, a tape holding mechanism located opposite to a surface of the workpiece and carrying a pad tape which comprises a tape substrate and grains bonded to the substrate, a first rotary mechanism for rotating said holder about a first vertical axis and a second rotary mechanism for rotating said tape holding mechanism about a second vertical axis, and an abrasive supplying mechanism for supplying free grains between the surface of said workpiece and said pad tape.

6. The apparatus of claim 5 which further comprises a tape conveying mechanism for feeding the pad tape intermittently from a feed reel to a take-up reel.

7. The apparatus of claim 5 or 6 which further comprises a reciprocating mechanism for reciprocating said holder in a horizontal direction.

8. A surface polishing apparatus comprising a holder for holding a flat workpiece, a tape holding mechanism located opposite to a surface of a held workpiece and carrying a pad tape which comprises a tape substrate and grains bonded to the substrate, a rotary mechanism for rotating said holder about a first vertical axis and a mechanism for reciprocating said holder in a horizontal direction and an abrasive supplying mechanism for supplying free grains between the surface of said workpiece and said pad tape.

9. The apparatus according to claim 8, which further comprises a rotary mechanism for rotating the tape holding mechanism about a horizontal axis.

10. The apparatus according to claim 8, which further comprises a tape conveying mechanism for feeding the pad tape intermittently from a feed reel to a take-up reel.

* * * * *